United States Patent [19]

Karm

[11] 4,408,637

[45] Oct. 11, 1983

[54] DOUBLE LAYER FORMING FABRICS FOR USE IN PAPER MAKING MACHINES

[75] Inventor: Robert Karm, Selestat, France

[73] Assignee: Martel, Catala & Cie, Selestat, FranceA

[21] Appl. No.: 191,837

[22] Filed: Sep. 29, 1980

[30] Foreign Application Priority Data

Nov. 19, 1979 [FR] France ..... 79 28501

[51] Int. Cl.[3] ..... D03D 15/00; D03D 15/02; B21F 1/10; B10D 39/08

[52] U.S. Cl. ..... 139/425 A; 139/413; 162/DIG. 1; 162/348

[58] Field of Search ..... 139/383 A, 425 A, 408–413; 162/DIG. 1, 348, 349, 358; 245/8, 10; 34/95, 116, 123

[56] References Cited

U.S. PATENT DOCUMENTS

| | | | |
|---|---|---|---|
| 3,915,202 | 10/1975 | Curtis et al. | 139/425 A |
| 4,041,989 | 8/1977 | Johansson et al. | 139/425 A |
| 4,086,941 | 5/1978 | Thompson | 139/383 A |
| 4,112,982 | 9/1978 | Bugge et al. | 139/425 A |
| 4,314,589 | 2/1982 | Buchanan et al. | 139/383 A |
| 4,356,844 | 11/1982 | Thompson | 139/383 A |

OTHER PUBLICATIONS

A Handbook of Weaves by G. H. Oelsner, published by the Macmillan Company, New York, 1915, pp. 31, 36, 272, 273.

*Primary Examiner*—James Kee Chi
*Attorney, Agent, or Firm*—Larson and Taylor

[57] ABSTRACT

A double layer forming fabric for use in a paper-making machine has a warp ratio of at least six strands and a shute ratio of at least twelve strands. The warp strands bind with the lower layer at locations distributed according to a satin weave pattern whose ratio is equal to the warp ratio; the warp strands bind with the upper layer at locations distributed according to a pattern whose aggregated ratio is equal to the warp ratio and which is constituted by the association of several weave patterns each having a warp ratio lower to 6 strands. There are at least two shute strands of the upper layer between two successive points where a warp strand comes down from the paper contacting face across the upper layer and then comes up again, respectively.

9 Claims, 11 Drawing Figures

DOUBLE LAYER FORMING FABRICS FOR USE IN PAPER MAKING MACHINES

BACKGROUND AND SUMMARY OF THE INVENTION

The invention relates to forming fabrics for paper-making machines of the type currently known as "double-layer" incorporating two layers of shute (or weft) strands and one layer of warp strands with a warp ratio of at least 6 strands or threads.

The expression "paper-making machine" should be construed in a broad sense and includes any type of apparatus for the manufacture of sheets from paper pulp, cellulose for paper stuff, regular paper, kraft, board and non-woven web either in the dryer part or the wet-end part; besides the invention is suitable for use when the sheet is formed either on an endless forming fabric, or between two endless fabrics, or between an endless fabric and a series of cylinders.

Numerous types of fabrics are used in paper-making machines; they are generally known as single-layer, double-layer and triple layer (or tri-layer). Single-layer fabrics are comprised of only one layer of lengthwise strands, and one single layer of crosswide strands; double-layer fabrics have only one layer of warp strands which bind two layers of shute strands, more or less superposed, arranged in pairs, and having the same number of strands per unit length in the upper layer (corresponding to the face into contact with the paper-sheet) and the lower layer (corresponding to the side in contact with the drainage elements of the paper machine). Generally, these fabrics are woven flat, and then seamed, so that the warp strands will be the lengthwise threads on the paper-machine.

Triple-layer fabrics include two layers of lengthwise strands which have not the same nature, particularly as regards their arrangement within the fabrics. The threads of one layer evolve mainly on the paper side, and those of the other mainly on the machine side. Moreover, the two layers are generally further different in respect of the diameter of the constituting strands or threads, their nature and the number of threads per unit width and shrinkage ratio during weaving.

Double-layer fabrics exhibit many advantages over single-layer fabrics and more especially an increased rigidity and an extended life. In a number of cases, there is a definite trend to use them rather than single-layer fabrics. On the other hand, triple-layer fabrics have not been broadly accepted since they are difficult to weave and require looms incorporating at least two beams, due to their including two distinct types of strands that develop in a different way.

Furthermore, it is known that the metal wires as well as synthetic monofilaments and multifilaments may be used as threads for weaving forming fabrics for paper-making machine. Compared to metal wires, plastic forming fabrics offer an extended life that results from the higher abrasion resistance of the synthetic strands. However, different weaving patterns must be adopted considering the increased flexibility of plastic threads and they usually result in a marking of the paper-sheet which differs a great deal from that imprinted by metal wires and that is not acceptable for certain paper grades, typically those for printing by the rotograve process.

It is an object of the invention to provide an improved multi-layer forming fabric of synthetic material for use on paper-making machines. It is a more specific object to provide fabrics which combine the favorable features of conventional double-layer fabrics, particularly extended life on paper machines and adequate resistance to dents, and of metal wires, particularly a faint marking.

With this object in mind, a double-layer fabric has an aggregate shute ratio of at least 12 strands; the binding points of the warp strands with the lower layer (which will be in contact with the drainage elements on the paper machine) are distributed according to a satin pattern, the ratio of which is equal to the aggregate warp ratio; the binding points of the warp strands with the shute strands of the upper layer (that will support the paper sheet on the paper machine) are distributed in a pattern having a cumulative ratio equal to the aggregate warp ratio, but comprised of the juxtaposition of two or three weave patterns each with a warp ratio lower to 6; and between each point where a warp strand passes down through the upper layer and the next point on where it passes up again through the upper layer, there are at least two shute strands of the upper layer.

The words "aggregate warp ratio" as used above, designate the number of strands constituting the smallest group of warp strands which is repeated in shute direction; the words "aggregate shute ratio" similarly designate the corresponding number of shute strands in warp direction. The expression "warp ratio", when applied to the binding points, designates the number of strands constituting the smallest group of warp strands whose binding points repeat as an invariably pattern.

The arrangement retains the advantages offered by the existing double-layer fabrics having high aggregate warp and shute ratios, especially the extended life due to the presence of shute strand long loops protruding on the machine side. At the same time, a faint marking is imparted to the paper sheet, contrary to most prior art double-layers which exhibited binding points arranged into regular or irregular satin patterns with a high ratio on the paper side.

It will be appreciated that the fabrics according to the present invention retain an arrangement of the binding points on the machine side, according to a satin pattern, with long shute loops, whereas on the paper side there are a large number of plain binding points, which constitute as many contact points between the fabric and the paper sheet. The fact that there are at least two shute strands of the upper layer between the place where a same warp thread comes down from the paper supporting face and then comes up again towards this face, assures an adequate distribution of the binding points of the warp and shute strands in the upper layer and reduces to an acceptable value the difference in level between the warp strand loops and the shute strand loops on the paper side. The result can be further improved by limiting the length of the shute strand loops on the paper side to a value corresponding to four warp threads, thereby limiting the stresses biasing the loops out of the fabrics plane and reducing the amount of protrusion which would result in excessive marks on the paper.

Numerous weave patterns can be used on the paper side, having a warp ratio lower than 6 and combined for their association to correspond to the required cumulated ratio of the binding points with the shute strand of the upper layer, for instance: long crimp; 2—2 or 2-3 twill weave; irregular four harness satin weave (broken or turkish satin), regular five harness satin.

An aggregate warp ratio of 8 threads frequently represents a satisfactory compromise between a high ratio—which is a factor contributing to high wear resistance of the fabric—and easy manufacture, which involves use of a weaving loom that incorporates a moderate number of harnesses.

In all cases, it should be noted that the fabric can be woven with a conventional loom incorporating only one warp beam or roll by existing weaving techniques.

As in the case of the conventional double-layer fabrics, for instance those described in U.S. Pat. No. 4,171,009 (KARM) in which reference may be made and which is incorporated in the present disclosure by way of reference, the lengthwise and crosswise threads may be selected from the group consisting of multi and monofilament synthetic yarns, possibly in association with metal threads; the threads can be coated or sheathed. All threads in a same fabric may be identical or a combination of different threads may be used. The filling ratio of the warp threads will typically be at least 1.05. Although it may usually prove advantageous to weave fabrics according to the invention by conventional so-called "flat" weaving and to seam the ends subsequently (which results in the shute threads being crosswise threads on the machine), it is also possible and of advantage for particular grades, to weave the fabric endless on a circular weaving loom. Then the end splicing step is omitted.

The invention will be better understood from the following description of particular embodiments given by way of examples only.

SHORT DESCRIPTION OF THE DRAWINGS

FIG. 1*a* is a schematic diagram of a weave pattern illustrating the binding of warp and shute threads of a first fabric, according to the invention;

FIG. 1*b* is a schematic illustration of the binding points between the warp threads and the shute threads of the two layers in a fabric with a weave pattern according to FIG. 1*a;*

FIG. 2, similar to FIG. 1*b*, illustrates a condition which, when fulfilled, reduces marking of the paper web by the fabric;

FIG. 3, similar to FIG. 1*a*, is an illustration of another fabric according to the invention;

FIGS. 4*a* and 4*b*, similar to FIGS. 1*a* and 1*b*, show yet another embodiment;

FIGS. 5 to 9, similar to FIG. 1*a*, illustrate still further embodiments.

On all figures which schematically illustrate weave patterns, the warp threads and the pairs of associated shute threads are shown with full continuous lines. At each warp and shute crossing.

no reference mark is made if the warp thread passes between the two layers or plies of superposed shute strands;

a "X" mark indicates that the warp thread passes over the upper ply of shute threads thereby constituting a binding with the upper layer of shute threads;

a "O" mark indicates that the warp strand passes under the lower ply of shute threads, thereby constituting a binding point with the lower layer of shute threads.

DETAILED DESCRIPTION OF PREFERRED EMBODIMENTS

Figure 1A:
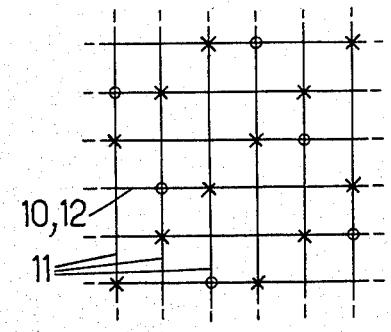
Figure 1B:
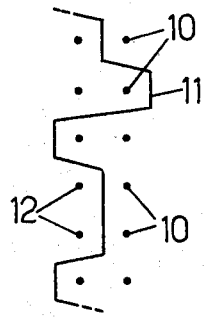

Referring to FIGS. 1*a* and 1*b*, there is illustrated the theoretical distribution of the crossing points in a fabric where the lower layer of shute threads 10 bind with the warp threads 11 according to an irregular satin weave pattern of six threads, whereas the binding points of the shute threads 12 of the upper layer with the warp strands 11 are distributed according to two juxtaposed twill weaves with a warp ratio of 3 leading to a cumulated warp ratio of 6 (i.e. a 6 repeat pattern). FIG. 1*b* makes it apparent that on the machine side or wear side the warp ratio is of 6 threads with only one crossing point, which explains the existence of long floats on the shute threads 10 which are in contact with dewatering elements of the paper machine. On the paper side, the greater number of plain binding points between warp threads 11 and shute threads 12 increases the number of contact points between the paper web and the fabric surface.

As stated above, the difference in level D (FIG. 2) between the loops formed by the warp strands 11 and the loops formed by the shute strands 12, should be low, with a view to reducing the mark, as explained for instance in British Pat. No. 1,415,339 (NORDISKA).

Figure 2:
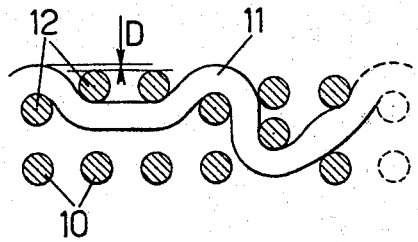

In field application, the admissible difference in level D generally does not exceed 0.02 mm. That result is attained in the example illustrated in FIGS. 1*a* and 1*b* by limiting the length of the floats of the shute threads or strands on the paper face so that they cover only two warp threads or strands; in consequence, the action tending to force them towards the outside of the fabric on the paper side is not excessive. It can furthermore be appreciated from FIGS. 1*b* and 2 that two shute strands 12 from the upper layer are interleaved between the place where a warp thread 11 comes down from the face in contact with the paper web and that where it comes up again to that face. In field applications, a minimum of two strands will generally be used. A larger number of strands in the upper layer may be selected, it being understood that a particular warp strand may lay under shute strands 12 of the upper layer only, as shown in FIG. 2, or also cover shute strands 10 of the lower layer, especially when a number of shute strands 12 exceeding two is interposed between descending and rising points of the warp strand 11.

Figure 3:
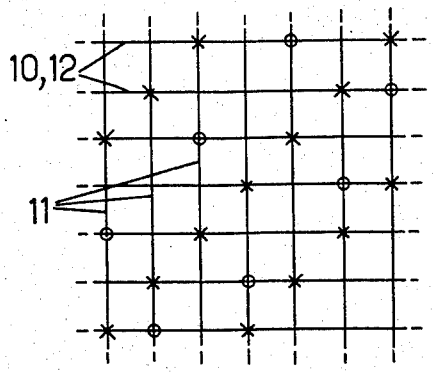

Referring now to the embodiment shown in FIG. 3 (where the elements corresponding to those illustrated in FIG. 1*a* are designated by the same reference number), the aggregate warp ratio is 7, whereas the aggregate shute ratio is 14. The shute strands 12 of the upper layer bind with the warp strands 11 according to a 3-shaft twill weave associated to a 4-weaved twill which gives a cumulated warp ratio of 7. The shute strands 10 of the lower layer bind with the warp strands 11 according to an irregular satin weave pattern of 7.

Figure 4A:
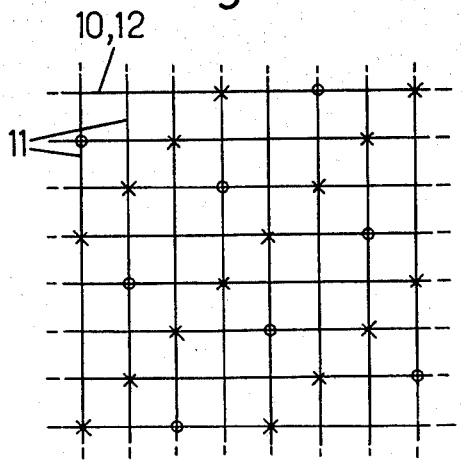
Figure 4B:
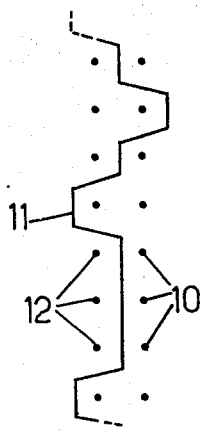

The embodiment illustrated in FIGS. 4*a* and 4*b* belongs to those that seem to offer the most advantageous compromise between the simplicity of the weaving looms and the easiness of weaving (which implies a number of shafts as low as possible, and an even ratio) and a high ratio, which renders it possible both to obtain long floats on the machine side and a split up on the paper side into several weave patterns having a low aggregate warp ratio. In the fabric illustrated in FIGS. 4*a* and 4*b*, the warp strands 11 bind with the shute strands 12 of the upper layer according to two juxtaposed 4-shaft twills, resulting in a cumulated warp ratio of 8. The shute strands 10 of the lower layer bind with the warp strands 11 according to a regular 8-shaft satin pattern with a shift of 5.

Figure 5:
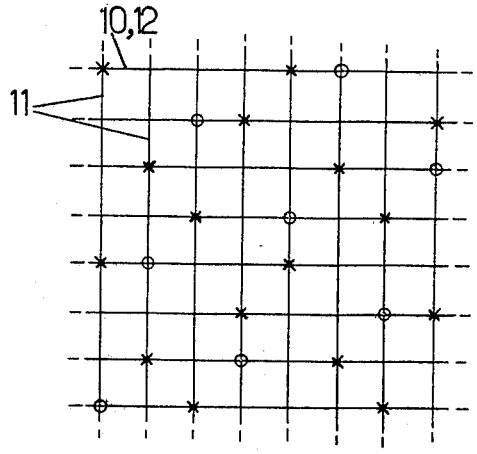

Referring to FIG. 5, there is illustrated a fabric having an aggregate warp ratio which again comprises 8 strands. The shute strands 12 of the upper layer bind with the warp strands 11 according to two juxtaposed irregular 4-shaft satins, also known as "Turkish" satin weave. The shute strands 10 of the lower layer bind with the warp strands according to a regular satin weave pattern of 8 with a shift of 3.

Figure 6:
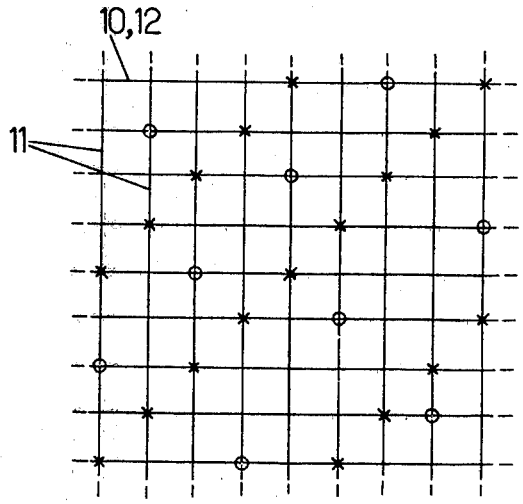

In the embodiment illustrated in FIG. 6, the shute strands 12 of the upper layer bind with the warp strands 11 according to two adjacent or a juxtaposed twills, namely a 5-shaft twill and a 4-shaft twill resulting in a cumulated warp ratio of 9.

The shute strands 10 of the lower layer bind with the warp strands according to an irregular satin weave pattern of 9.

Figure 7:
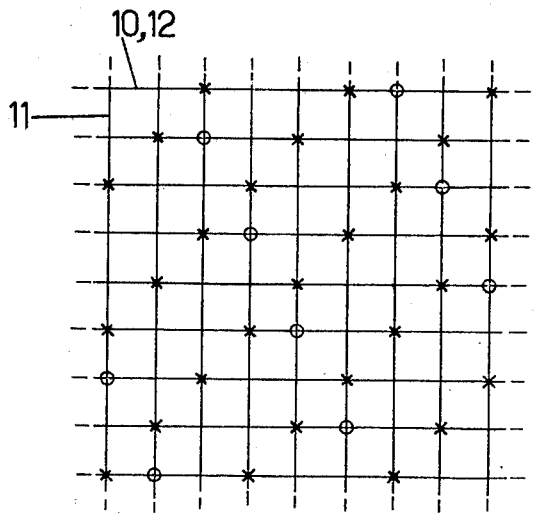

Referring to FIG. 7, the shute strands 12 of the upper layer bind with the warp strands according to three juxtaposed 3-shaft twill weave patterns resulting in a cumulated warp ratio of 9. The shute strands 10 of the lower layer bind with the warp strands 11 according to a regular 9-shaft satin weave pattern with a shift of 4.

Figure 8:
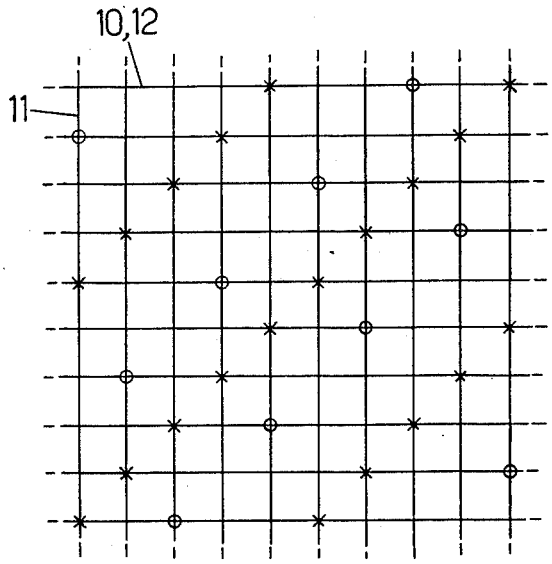

Referring to FIG. 8, the shute strands 12 of the upper layer bind with the warp strands according to two juxtaposed 5-shafts twills resulting in a cumulated warp ratio of 10. The shute strands 10 of the lower layer bind with the warp strands 11 according to an irregular satin weave pattern of 10 with alternating shifts of 7 and 5.

Figure 9:
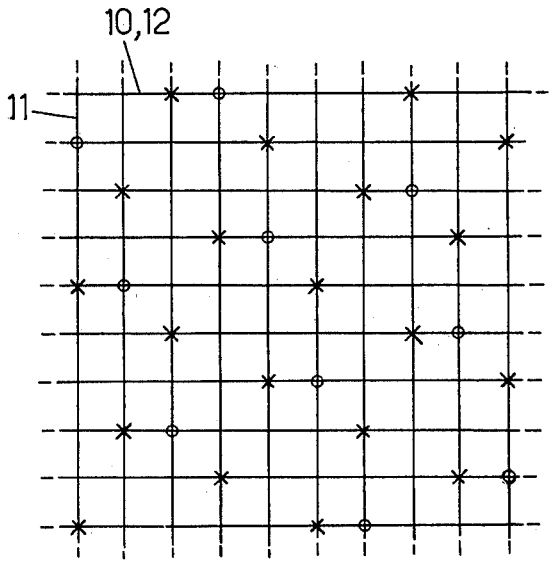

Referring to FIG. 9, the shute strands 12 of the upper layer bind with the warp strands 11 according to two juxtaposed regular 5-shaft satin patterns with shifts of 3, resulting in a cumulated warp ratio of 10. The shute strands 10 of the lower layer bind with the warp strands 11 according to a regular 10-shaft satin with a shift of 3.

In all illustrated cases, the number of binding points of the warp strands 11 with the shute strands 12 of the upper layer is at least double to the number of binding points of these warp strands 11 with the shute strands 10 of the lower layer. Referring to FIG. 1*b*, it will be appreciated that there are two upper bindings per lower binding. The same applies to FIGS. 3, 4, 5, 6, 8 and 9. On the other hand, there are three upper binding points per lower binding point in FIG. 7.

Fabrics woven according to the invention will in most cases be manufactured by the flat weaving process and then seamed by splicing the ends. As a result of this arrangement, the fabric will have its shute strands placed in cross-machine direction which will contribute to obtain a high transverse rigidity and an extended life on the paper machine, as the wear will first develop on the crosswise strands and more especially, those of the lower layer. Nevertheless, in certain cases, one will be led to weave the fabric endless by the circular weaving process, in which case the shute strands will be in the machine running direction.

The invention is not limited to the peculiar embodiments and weaving methods illustrated and described by way of examples, and it must be understood that the protection is limited by the appended claims only and particularly includes embodiments having more than two layers.

I claim:

1. Multi-layer endless forming fabric for paper-making machine and the like, comprising at least:

an upper layer of shute threads located on the material forming side of the fabric, a lower layer of shute threads located on the wear or machine side of the fabric, and longitudinal warp threads interwoven with the layers of shute threads, said fabric being woven with an aggregate warp ratio of at least 6 threads and an aggregate shute ratio of at least 12 strands, wherein the binding points of the warp threads with the lower layer are distributed in a satin weave pattern, the ratio of which is equal to the aggregate warp ratio;

wherein the binding points of the warp threads with the shute threads of the upper layer are distributed according to a pattern having a cumulated ratio equal to the aggregate warp ratio, but constituted by juxtaposed weaving patterns each with a warp ratio lower than 6; and wherein there are at least two shute threads of the upper layer between each point where a warp thread comes down through the upper layer and another point farther on where it comes up again through that same upper layer.

2. A fabric according to claim 1, wherein the shute threads have floats over the upper layer feature which cover up to four warp threads.

3. A fabric according to claim 1, wherein the number of binding points of the warp threads with the shute threads of the upper layer is at least double the number of binding points of the warp threads with the shute threads in the lower layer.

4. A double-layer endless forming fabric for paper-making machine and the like, comprising:

an upper layer of synthetic shute threads located on the material forming side of the fabric, a lower layer of synthetic shute threads transverse to said direction and located on the machine side of the fabric, and synthetic warp threads interwoven with the layers of shute threads, said fabric being woven with an aggregate warp ratio of 8, wherein the binding points of the warp threads with the shute threads of the lower layer are distributed according to a satin weave pattern with a ratio of 8 threads, wherein the binding points of the warp threads with the shute threads of the upper layer have a cumulated ratio equal to eight but the distribution is constituted by two juxtaposed weave patterns of four, having each a warp ratio of four, and wherein there are three shute threads from the upper layer between each point where a warp thread passes down through the upper layer and the next point farther on where it passes up through that same layer.

5. A fabric according to claim 1 or 4, wherein the binding points of the warp threads with the shute threads of the upper layer are distributed according to two juxtaposed 4-shaft twill weave patterns.

6. A fabric according to claim 1 or 4, wherein the binding points of the warp threads with the shute threads of the upper layer are distributed according to two juxtaposed, irregular 4-shaft satin weave patterns.

7. A fabric according to claim 1 or 4, wherein some at least of the threads are selected from the group consisting of synthetic multifilament strands and synthetic monofilament strands.

8. A fabric according to claim 1 or 4, wherein the warp filling ratio is at least 1.05.

9. A fabric according to claim 4, flat woven and rendered endless by splicing, wherein the shute threads are arranged crosswise to machine running direction and the warp threads lengthwise.

* * * * *